US008794246B2

(12) United States Patent
Springfield-Thomas

(10) Patent No.: US 8,794,246 B2
(45) Date of Patent: Aug. 5, 2014

(54) SELF ADMINISTRABLE HAIR EXTENSION SYSTEM AND METHOD

(76) Inventor: Tara Springfield-Thomas, Farmington, NY (US)

( * ) Notice: Subject to any disclaimer, the term of this patent is extended or adjusted under 35 U.S.C. 154(b) by 0 days.

(21) Appl. No.: 13/596,946

(22) Filed: Aug. 28, 2012

(65) Prior Publication Data

US 2013/0048006 A1 Feb. 28, 2013

Related U.S. Application Data

(60) Provisional application No. 61/528,779, filed on Aug. 30, 2011.

(51) Int. Cl.
*A41G 5/00* (2006.01)
*A41G 3/00* (2006.01)

(52) U.S. Cl.
CPC ..... *A41G 5/0053* (2013.01); *A41G 5/006* (2013.01)
USPC ..... 132/53; 132/201

(58) Field of Classification Search
CPC ... A41G 3/008; A41G 3/0016; A41G 3/0033; A41G 5/00; A41G 5/0013; A41G 5/002; A41G 5/0026; A41G 5/004; A41G 5/0053; A41G 5/006; A41G 5/0073
USPC ..... 132/53–56, 200
See application file for complete search history.

(56) References Cited

U.S. PATENT DOCUMENTS 5,154,195 A * 10/1992 Irisawa ..... 132/201
5,419,345 A * 5/1995 Kadymir ..... 132/54

* cited by examiner

*Primary Examiner* — Rachel Steitz
(74) *Attorney, Agent, or Firm* — Tracy Jong Law Firm; Tracy P. Jong; Cheng Ning Jong

(57) ABSTRACT

A holder for securing a hair extension having a weft and a hair piece extending from the weft, to a wearer's natural hair. The holder includes a length, a transverse profile having a hair extension edge and a securing edge opposingly disposed from the hair extension edge. The holder comprises a channel disposed substantially longitudinally along the entire length of the holder and a plurality of apertures to receive a plurality of attaching means for securing the holder to the wearer's natural hair. The channel includes a neck and an interior cavity connected to the neck, wherein the neck defines an opening along the length of the channel at the hair extension edge. The interior cavity is configured to receive the weft and the neck is configured to enable penetration of the hair piece through the opening along the length of the channel.

6 Claims, 12 Drawing Sheets

FIG. 10
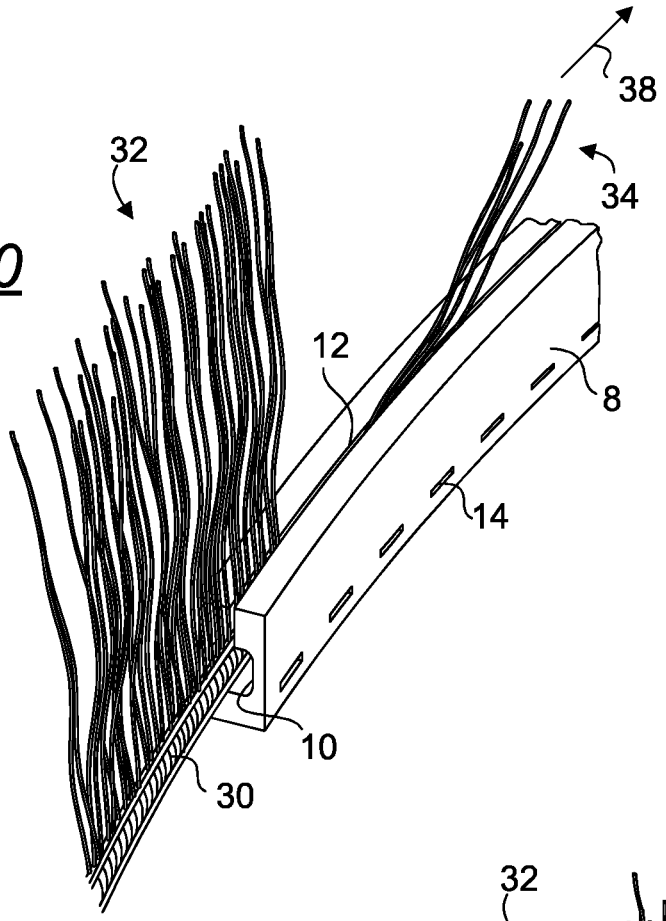
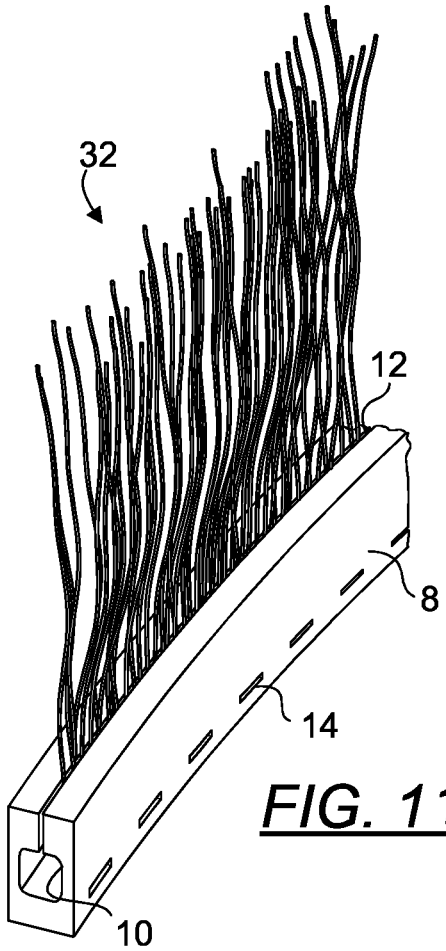
FIG. 11

SELF ADMINISTRABLE HAIR EXTENSION SYSTEM AND METHOD

PRIORITY CLAIM AND RELATED APPLICATIONS

This non-provisional patent application claims the benefit of priority from provisional application U.S. Ser. No. 61/528,779 filed Aug. 30, 2011. Said application is incorporated by reference in its entirety.

BACKGROUND OF THE INVENTION

1. The Field of the Invention

The present invention is directed generally to a self-administrable hair extension system and more particularly to a self-administrable hair extension system using conventionally available hair extensions.

2. Background Art

The present invention is a hair extension holder that enables self administration of conventionally available wefted hair extensions (hair extensions that are attached to a weft). onto ones own head.

Welted hair extensions come in a variety of colors, lengths and styles. They change/enhance the appearance of a wearer by covering a portion or the entire head of the wearer. Traditionally, in order to attach wefted hair extensions, the wearer's natural hair is braided into corn rows and the weft of the hair extension is sewn directly onto the braided hair with a hook needle and thread.

Welted hair extensions (also referred to as a weave) are particularly popular amongst African American women whose own natural hair tends to be quite frizzy and short. Weaves provide women of color the opportunity to choose from an endless assortment of wefted hair extensions that their own hair is unable to replicate.

Traditionally, both synthetic/human wefted hair extensions have been semi-permanently attached to a wearer's own natural hair by techniques such as bonding (using glue to adhere the extension) and weaving (braiding the wearer's natural hair into braids and attaching the wefted hair extension directly onto the braided hair with a hooked needle and thread).

The bonding and weaving techniques have to be administered by a hair extension professional which can be extremely expensive and time consuming. Once the hair extensions are attached, the wearer is unable to change the extension until they are professionally removed 4-6 weeks later. If the hair extensions become damaged or the wearer no longer wants their chosen style, both techniques prevent the wearer from removing the extensions without costly consequences both for labor and the purchase of new extensions.

Maintenance of hair extensions require the wearer to limit activities such as working out/sports (whereby profuse sweating occurs), swimming (chlorine) and getting the hair extensions wet while bathing. If the wearer mismanages their hair extensions by repeatedly subjecting them to destructive elements, they will immediately begin to shed and lose their natural looking appearance by becoming excessively dry and matted (fake looking). Also, bonded hair extensions can fuse to a wearer's own hair. Therefore, the only way to remove the extension is to cut the wearer's natural hair off as well.

Bonding and weaving semi-permanent hair extensions are popular, however, the most time and cost effective alternative is temporary hair extensions. Temporary hair extensions allow a wearer to easily attach/remove the extension themselves within a short time frame. However, temporary hair extensions do not adequately adhere to the wearer's own hair because the attachment devices are unreliable clips, mini combs and other flimsy devices.

The sole purpose of using hair extensions is to enhance the wearer's appearance. However, temporary hair extensions run the risk of becoming unsecured and falling out. Temporary hair extensions may also damage the wearer's own hair by bonding to it. Further, temporary hair extensions prevent the wearer from changing her extensions for 4-6 weeks.

Therefore a need arises for a device which enables the wearer of hair extensions to reliably secure her own hair extension and change the extensions at a moment's notice without needing professional assistance. The device would be extremely cost effective (eliminating professional labor fees), quick to apply because the extension slides into place and gives the wearer the power to choose or change her style whenever she desires.

SUMMARY OF THE INVENTION

The present invention is directed toward a hair extension holder (hereinafter referred to as holder) for securing a hair extension having a weft and a hair piece extending from the weft, to a person's natural hair. The holder includes a length, a transverse profile having a hair extension edge and a securing edge opposingly disposed from the hair extension edge. The holder comprises a channel disposed substantially longitudinally along the entire length of the holder and a plurality of apertures to receive a plurality of attaching means for securing the holder to the person's natural hair. The channel includes a neck and an interior cavity connected to the neck, wherein the channel and the neck are disposed longitudinally along substantially the entire length of the holder. The neck defines an opening along the length of the channel at the hair extension edge. The plurality of apertures is disposed substantially along the securing edge. The interior cavity is configured to receive the weft while the neck is configured to contactingly secure and enable penetration of the extended hair piece through the opening along the length of the channel.

Accordingly, it is a primary object of the present invention to provide a hair extension system that is self-administrable by its wearer, thereby eliminating the time consuming and costly processes of removing undesired hair extensions and sewing new hair extensions directly to the wearer's natural hair.

It is another object of the present invention to provide a hair extension system that allows quick removal and administering of positively secured hair extensions, thereby enabling a practical way to alter their wearer's appearance quickly.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which:

FIG. 10 is a partial perspective view of a holder depicting a method by which a hair extension is slid into a present holder.

FIG. 11 is a partial perspective view of a holder depicting the end result of sliding a hair extension into the present holder of FIG. 10.

PARTS LIST

Figure 1:
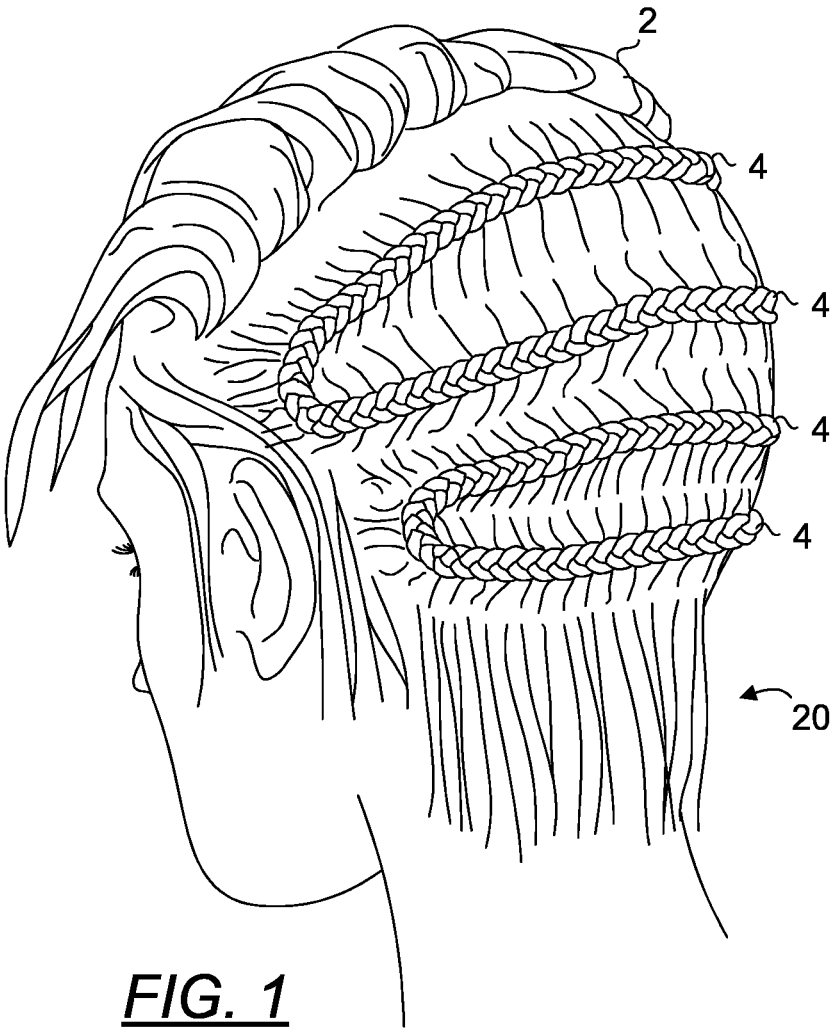
FIG. 1 is a rear perspective view of a wearer depicting a preparation process that is carried out in anticipation of the administration of hair extensions.

2—natural hair
4—braided hair
6—scalp
8—holder
9—channel
10—interior cavity of channel
11—corner of interior cavity
12—neck of channel
14—aperture for threadable attachment of holder to the braided hair
16—height of opening of channel
18—height of neck of channel
20—wearer
22—width of neck of channel
24—width of opening of channel
26—height of holder
28—width of holder
30—weft
32—hair extension
33—extended hair piece
34—starter hair bundle
36—thread for attaching holder to braided hair
38—direction in which starter hair bundle is pulled
40—hair extension edge
42—securing edge
44—notch
46—outer wall of holder
48—prepared hair extension holder
50—connecting strap
52—male adjustment strap
54—female adjustment strap
56—hook
58—eyelet
60—outer adjustment band
62—securing thread
64—outside periphery end
66—central end
68—elastic band
70—aperture for threadable attachment of connecting straps and outer adjustment band to the braided hair
72—perpendicular distance between two loops
74—thread for attaching holder to outer adjustment band
76—non-closed outer band
78—top loop Particular Advantages of the Invention The present holder eliminates the need to sew hair extensions onto braided hair, thereby enabling one to administer hair extensions herself or with the help of an unskilled person. As hair extensions can be administered by an unskilled person utilizing the present holders, the hair extensions can be removed by the wearer herself or an unskilled person as well, with little effort and in a minimal amount of time, thereby saving time and labor costs. The present holders can be removed easily, enabling changing of hair extensions and therefore hairstyles within a short period of time, typically within an hour. The present holders enable at will removal of hair extensions when they are not in use, such as when the wearer is not showing off her hair extensions, in shower or when she goes to sleep, in contrast to a typical continuous use period of about three months if the hair extensions are sewn in. As hair extensions can be removed easily, they can be maintained more easily by their wearer when they are removed from their wearer. There may also be occasions where the wearer prefers to perform certain tasks without her hair extensions attached.

In some embodiments, the present holder is attached to a support frame to form an assembly which enables the present holder to be more easily and readily deployed on a wearer's head. In such embodiments, any guesswork involved in arranging the present holder in a manner to properly act as a foundation for securing hair extensions to the wearer's head is removed. The assembly is simply positioned on the wearer's head before an adjuster is engaged to apply suitable tension around the person's head.

Detailed Description of a Preferred Embodiment

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

The present holder 8 is designed to be semi-permanently attached to a wearer's natural hair. The term "semi-permanent" as used herein is defined as a state that is left unaltered for two to three months. Conventionally, a hair extension is sewn directly onto natural hair that has been braided. Braiding provides the foundation for threadable connection of hair extensions to the wearer's head. Such a sewn-in hair extension is left in place for two to three months. A wearer of sewn-in hair extensions would typically be reluctant to have her extensions removed after having only used them for days or even weeks as the cost of administering hair extensions is tremendous and it can take several hours to fully administer hair extensions to a wearer. Conventional means for sewing hair extensions to natural hair is not self-administrable. It is often necessary to remove the administered hair extensions in three months as the natural hair to which the hair extensions are attached has grown to a point that it compromises the attaching means utilized to secure the hair extensions to the natural hair. In addition, as a result of prolonged usage of hair extensions of certain style and color, a wearer may grow tired of the hair extensions and prefer hair extensions of other styles and colors.

The above drawbacks are solved by providing a means for making the removal and administering of hair extensions self-administrable and by making these activities easy and quick. The Applicant has come up with a holder that can be positively secured to the natural hair and holds a hair extension securely. The holder is preferably semi-permanently and positively secured to a wearer's natural hair. One or more conventional hair extensions are then positively secured to the holders. The wearer may choose to either leave the one or more hair extensions attached to the holder during the entire period the holder is left attached to the natural hair or remove and replace hair extensions one or more times during the period the holder is left attached. The present holder therefore provides the wearer a choice to alter her looks more frequently and if this choice is so chosen, the ability to alter her looks using various hair extensions quickly and rather effortlessly. The term "positive" is applied to hair extension securement that cannot be accidentally dislodged, thereby excluding securement using clips, friction fit between hair extensions and the wearer's natural hair or gravity.

Figure 2:
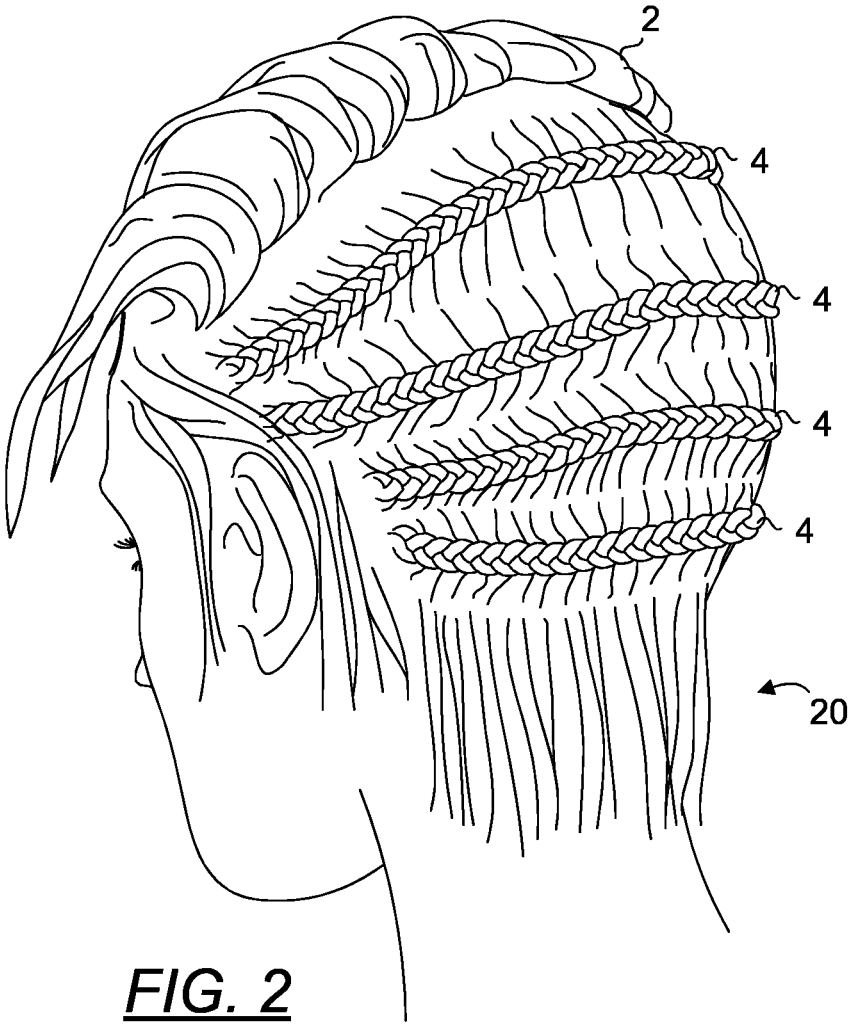
FIG. 2 is a rear perspective view of a wearer depicting an alternate preparation process that is carried out in anticipation of the administration of hair extensions.

FIG. 1 is a rear perspective view of a wearer 20 depicting a preparation process that is carried out in anticipation for administering of hair extensions. In the example shown, the natural hair 2 on the rear of the head is arranged in a continuous braid 4 leaving only the natural hair 2 on top of the head or at the bottom fringe in their natural form for blending in the hair extensions to be secured to the braids 4. In general, the braids 4 are created in horizontal formation with curves disposed only near the ears of the wearer 20. Horizontal braids 4 are used to facilitate in-line attachment of hair extensions to create natural looks. However, it is unnecessary to provide braids 4 in a continuous format as shown in FIG. 1. Braids 4 serve as strong foundation on which holders 8 are attached. As long as braids 4 are disposed in suitable locations on the rear of the head, holders 8 may be appropriately positioned to strategically position hair extensions to sufficiently cover the rear of the head. FIG. 2 is a rear perspective view of a wearer 20 depicting an alternate preparation process that has been carried out in anticipation for administering of hair extensions. In this example, the braids 4 are generally arranged to span the back of the head from the left ear on one side to the right ear on the other side.

Figure 3:
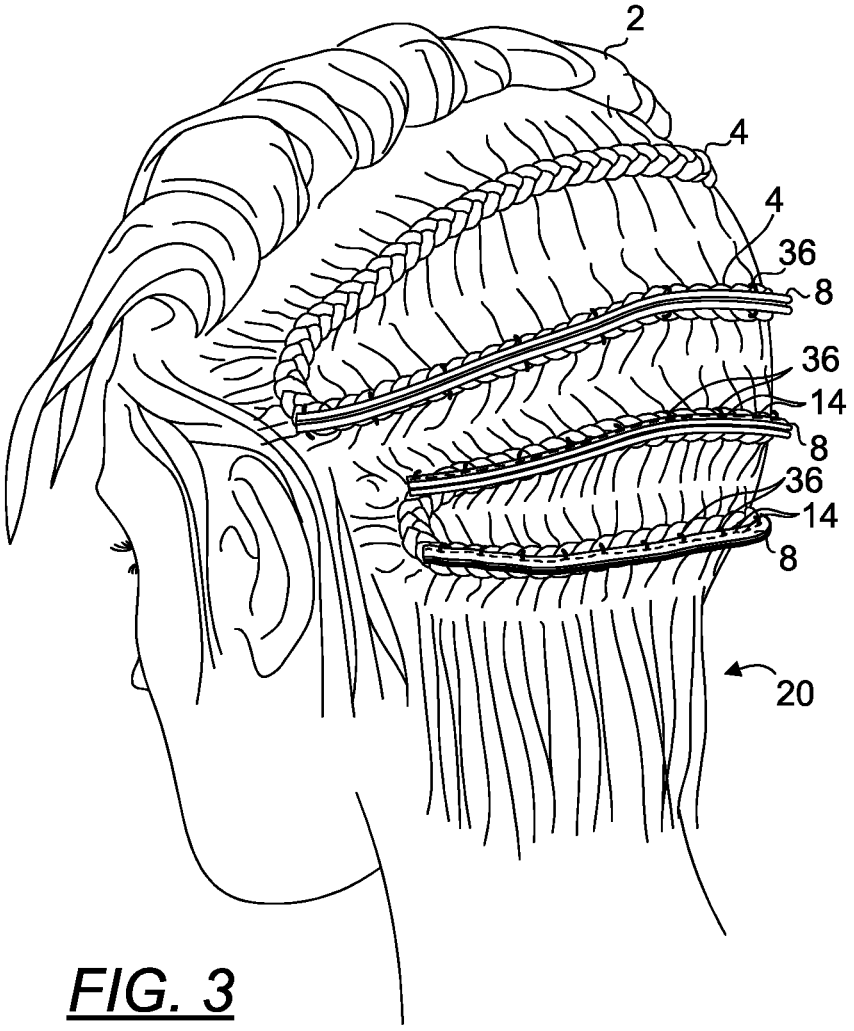
FIG. 3 is a rear perspective view of a wearer depicting several holders which have been secured to braids of the wearer.

FIG. 3 is a rear perspective view of a wearer 20 depicting several holders 8 which have been secured to the braided hair 4 of their wearer 20. Several holders 8 are shown secured to braids 4. Each holder 8 is disposed substantially in alignment with a braid 4. In one embodiment, each holder 8 comprises a plurality of apertures 14 for allowing threadable engagement of the holder 8 to a braid 4 using threads 36. A thread 36 is threaded through an aperture of a holder 8 and looped around and closed around a braid 4 to positively secure the holder 8 to the braid 4. One single thread may also be alternatingly looped through a plurality of apertures 14 of a holder 8 and a braid 4 to secure the holder 8 to the braid 4. In the latter case, the single thread is terminated or knotted or positively secure to the braid 4 at both ends. In another embodiment, a holder 8 is secured to a braid 4 by means of one or more clips disposed along the length of a holder 8.

Figure 4:
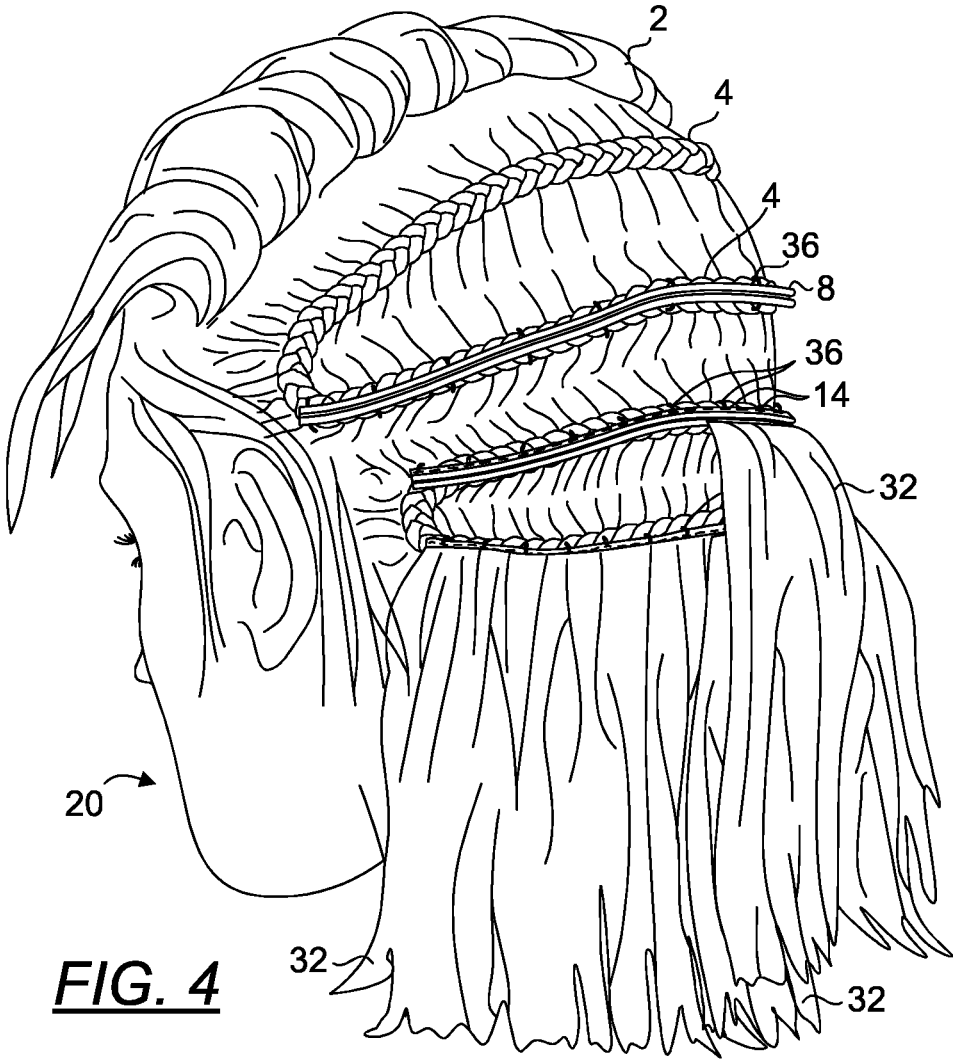
FIG. 4 is a rear perspective view of a wearer depicting several wefted hair extensions which have been secured to the holders of FIG. 3.
Figure 5:
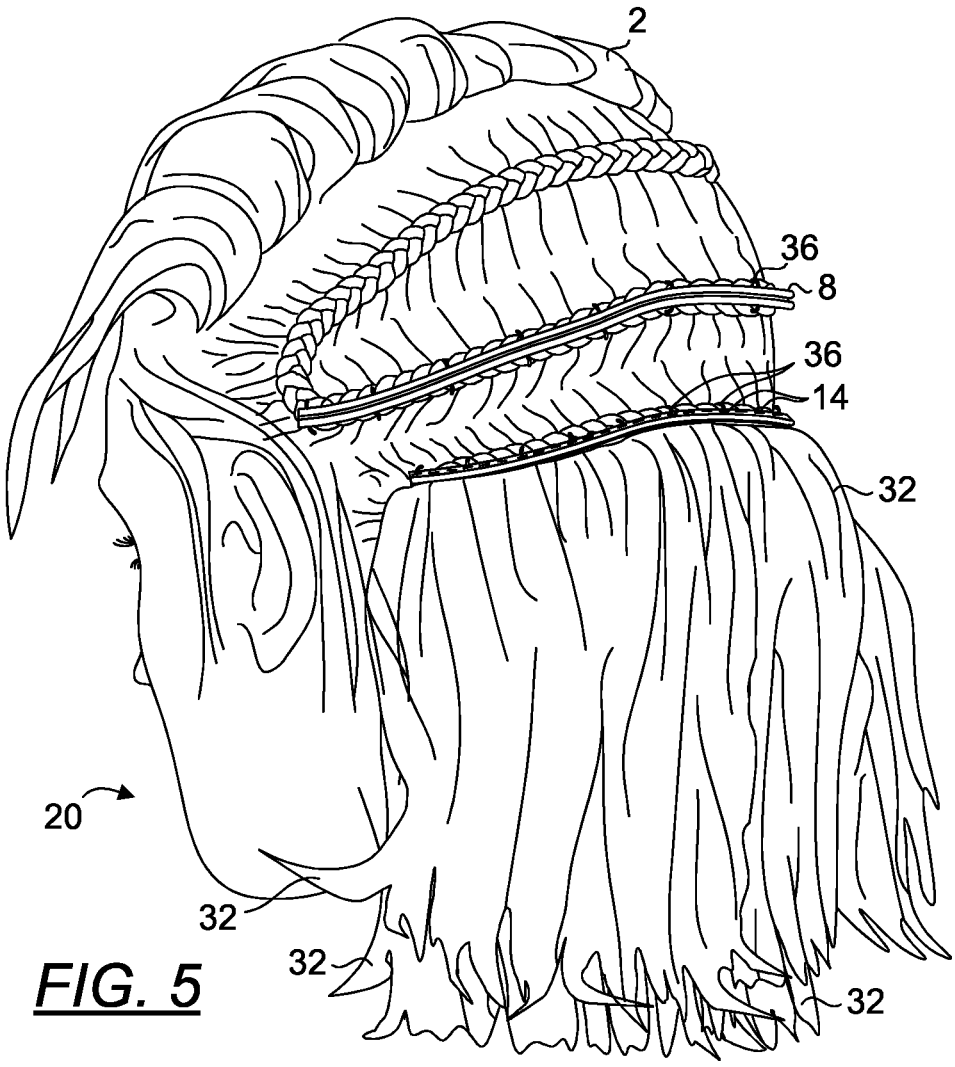
FIG. 5 is a rear perspective view of a wearer depicting an additional hair extension having been secured to a holder of FIG. 4.
Figure 6:
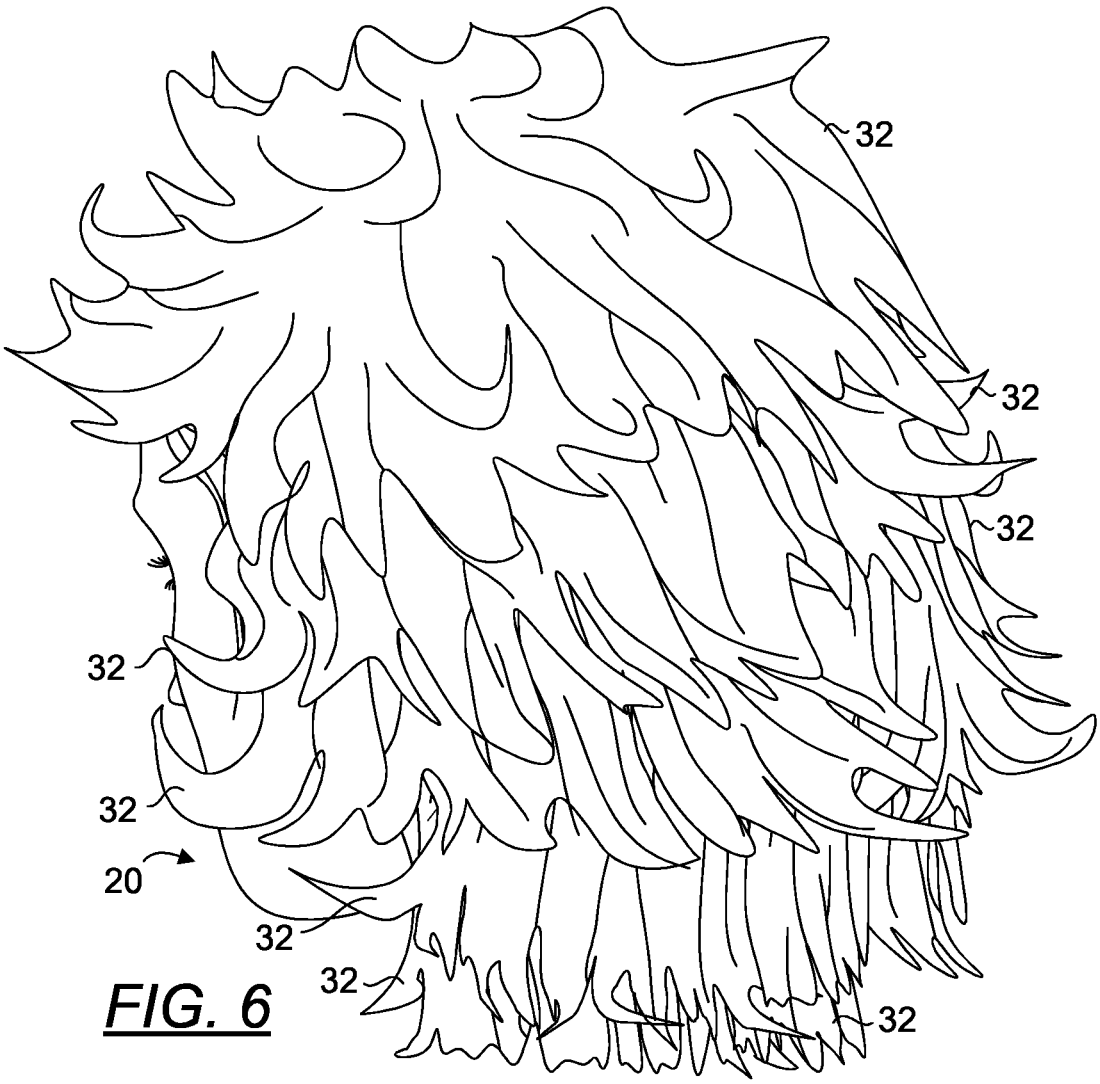
FIG. 6 is a rear perspective view of a wearer after hair extensions have been fully administered.

FIG. 4 is a rear perspective view of a wearer 20 depicting several hair extensions 32 which have been secured to the holders 8 of FIG. 3. Although unnecessary, hair extensions 32 are typically added bottom up to make the job of administering hair extensions easier as upper hair extensions tend to drape over lower hair extensions to create a layering effect. Layering also aids in concealing holders 8 and their corresponding braids 4. FIG. 5 is a rear perspective view of a wearer depicting an additional hair extension 32 having been secured to an additional holder 8 of FIG. 4. FIG. 6 is a rear perspective view of a wearer 20 after hair extensions 32 have been fully administered.

Figure 7:
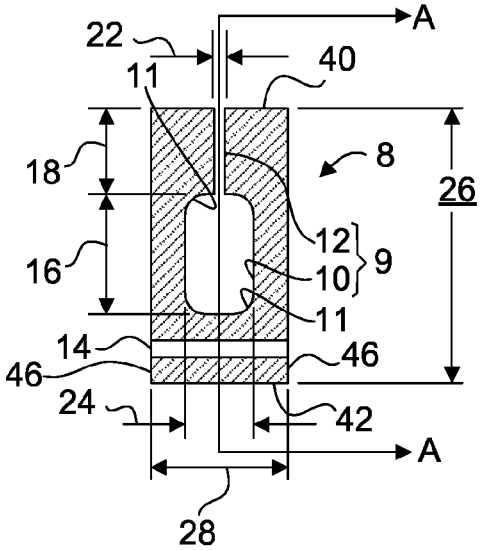
FIG. 7 is a transverse cross-sectional view of a holder according to the present invention.
Figure 8:
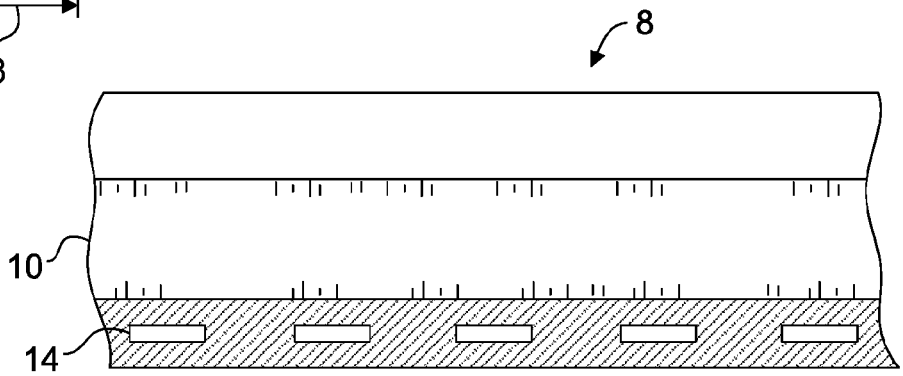
FIG. 8 is a partial longitudinal cross-sectional view of the holder of FIG. 7 as taken along line A-A of FIG. 7.

FIG. 7 is a transverse cross-sectional view of a holder 8 according to the present invention. FIG. 8 is a partial longitudinal cross-sectional view of the holder 8 as taken along line A-A of FIG. 7 to depict the arrangement of apertures 14 configured to receive attaching means which secures the holder 8 to natural hair. The holder 8 is essentially an elongated block including a transverse profile having a hair extension edge 40 and a securing edge 42 that is opposingly disposed from the hair extension edge 40. A channel 9 is disposed substantially longitudinally along the entire length of the holder 8 on the hair extension edge 40 of the holder 8. The channel has an interior cavity 10 and a neck 12 which connects to the interior cavity 10 and opens up to the hair extension edge 40.

A plurality of apertures 14 is disposed substantially along the securing edge 42. The height 26 of the holder 8 preferably ranges from about 0.25 to about 0.5 inch while the width 28 of the holder 8 preferably ranges from about ⅛ to about ¼ inch. The interior cavity 10 has essentially a rectangular profile having a height 16 of from about ⅛ to about ¼ inch and a width 24 of from about 1/16 to about ⅛ inch. In one preferred embodiment, the corners 11 of the interior cavity 10 are curved to eliminate stress concentration at the corners 11. The width 22 and height 18 of the neck 12 preferably ranges from about 1/32 to about 1/16 inch and from about 1/8 to about 1/4 inch respectively.

Figure 9:
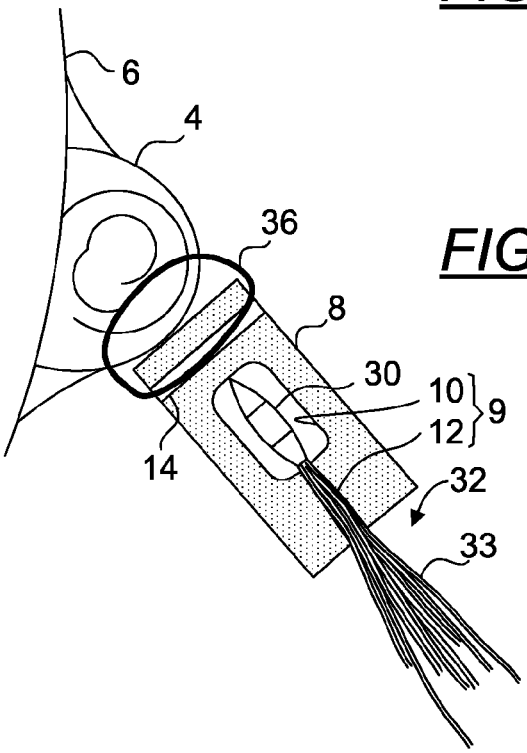
FIG. 9 is a partial cross-sectional view of an extended hair scenario depicting an administered hair extension that is secured to braided hair.

FIG. 9 is a partial cross-sectional view of an extended hair scenario depicting an administered hair extension that is secured to braided hair 4. A hair extension 32 typically includes a weft 30 and an extended hair piece 33. The weft 30 is a woven portion of the hair extension 32 typically made of a piece of webbing which provides a substrate for attachment to a wearer. An exemplary wefted hair extension is OCH Silky Straight 22" by Wig Pro Wefted Hair Extensions as shown on http://www.hairextensions.com/ product.php?productid=209&cat=22&page=1. Conventionally, a hair extension 32 as depicted in FIG. 9 is sewn onto a braid 4. The Applicant provides a holder 8 which acts an interface for receiving a hair extension which itself is semi-permanently secured to a braid 4. In one embodiment, the holder 8 is secured to a braid 4 with a plurality of threads 36 looped through a plurality of apertures 14. Each hair extension 32 is positively disposed within the channel 9 such that its wearer can be confident that accidental dislodgement will not occur under normal use. The neck 12 is configured sufficiently narrow such that the weft 30 may not be pulled out of the holder 8 via the neck 12. The interior cavity 10 is configured sufficiently large to accommodate the weft 30 but small enough to not be an obstacle for its wearer. The holder 8 is preferably made of a transparent plastic or rubber that is sufficiently flexible so that it is less conspicuous should a holder 8 is accidentally exposed and capable of spanning at least half of the back of the wearer's head. In one embodiment, the holder 8 is made of an extrusion process of a plastic material followed by a process that removes materials in the transverse direction of the extruded holder 8 to form apertures 14.

FIG. 10 is a partial perspective view of a holder 8 depicting a method by which a hair extension 32 is slid into a present holder 8. FIG. 11 is a partial perspective view of a holder 8 depicting the end result of sliding a hair extension 32 into the present holder 8 of FIG. 10. In order to administer a hair extension 32 onto a present holder 8, at least one strand of extended hair piece 33 or preferably a plurality of hair strands (or hair bundle 34) is separated from one longitudinal end of the hair extension 32. One end of the holder 8 is then located so that the weft 30 of the hair extension 32 can be aligned with the interior cavity 10. It shall be apparent that one may choose to align the hair extension 32 with the holder 8 first before separating one end of the hair extension 32 into a bundle 34 without altering the essence of administering the hair extension 32. The hair bundle 34 is then slid through the neck 12 such that the weft 30 enters the interior cavity 10. The hair bundle 34 continues to be pulled in direction 38 or in a direction substantially parallel to the lengthwise direction of the holder 8 until the hair extension 32 is seated in its entirety in the interior cavity 10. The wearer may choose to use one continuous holder 8 to accommodate more than one hair extension 32. In any case, the length of the interior cavity 10 preferably substantially matches the total length of weft 30 used.

Figure 12:
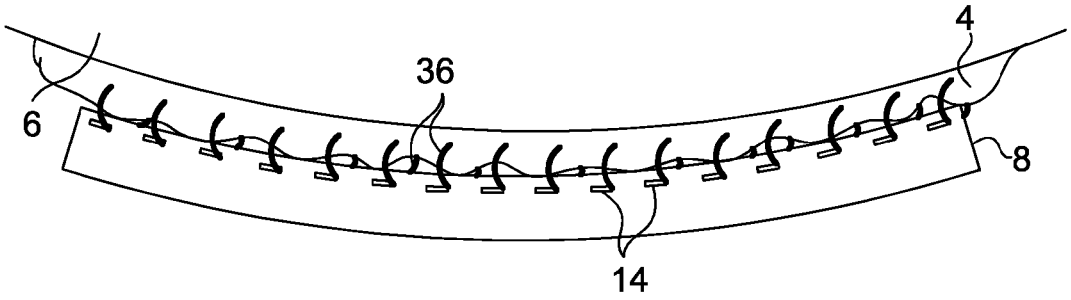
FIG. 12 depicts one embodiment of the present holder which allows bending to conform to the curvature of the back of a wearer's head.
Figure 13:
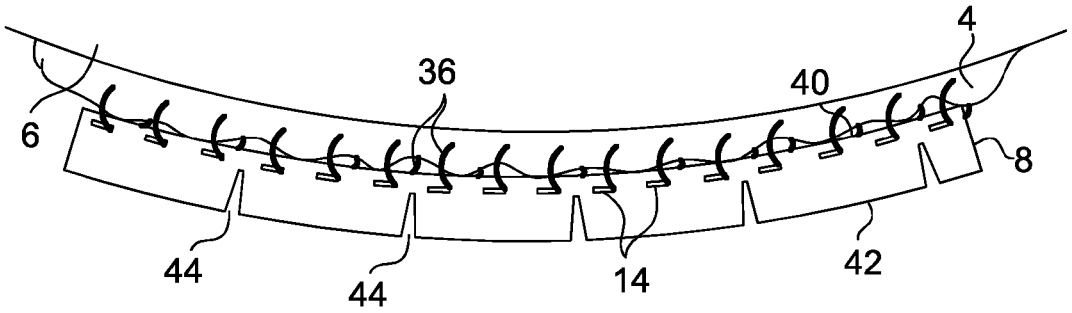
FIG. 13 depicts another embodiment of the present holder which allows bending to conform to the curvature of the back of a wearer's head.
Figure 14:
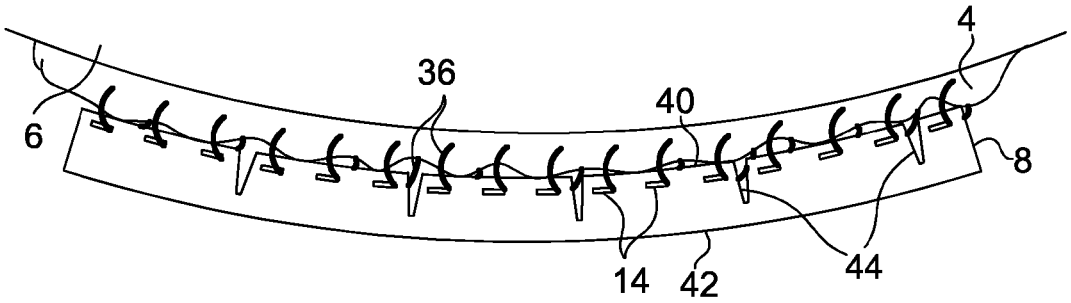
FIG. 14 depicts yet another embodiment of the present holder which allows bending to conform to the curvature of the back of a wearer's head.

FIG. 12 depicts one embodiment of the present holder 8 constructed to allow bending to conform to the curvature of the back of a wearer's head. Referring to FIGS. 7 and 12, the width 28 and height 26 of the holder 8 are minimized such that the holder 8 is sufficiently flexible to bend. In one embodiment, the holder 8 is capable of a curvature having a radius of from about 2 to about 4 inches with the outer wall 46 remaining substantially in a single plane. FIG. 13 depicts another embodiment of the present holder 8 which allows increased bending to conform to the curvature of the back of a wearer's head. In this embodiment, a plurality of notches 44 is spaced apart and disposed on the hair extension edge 40 along the entire length of the holder 8 to enable more severe curves to form for tighter curve requirements such as in those wearers having smaller heads. FIG. 14 depicts yet another embodiment of the present holder 8 which allows bending to conform to the curvature of the back of a wearer's head. In this embodiment, a plurality of notches 44 is spaced apart and disposed on the securing edge 42 along the entire length of the holder 8.

Figure 15:
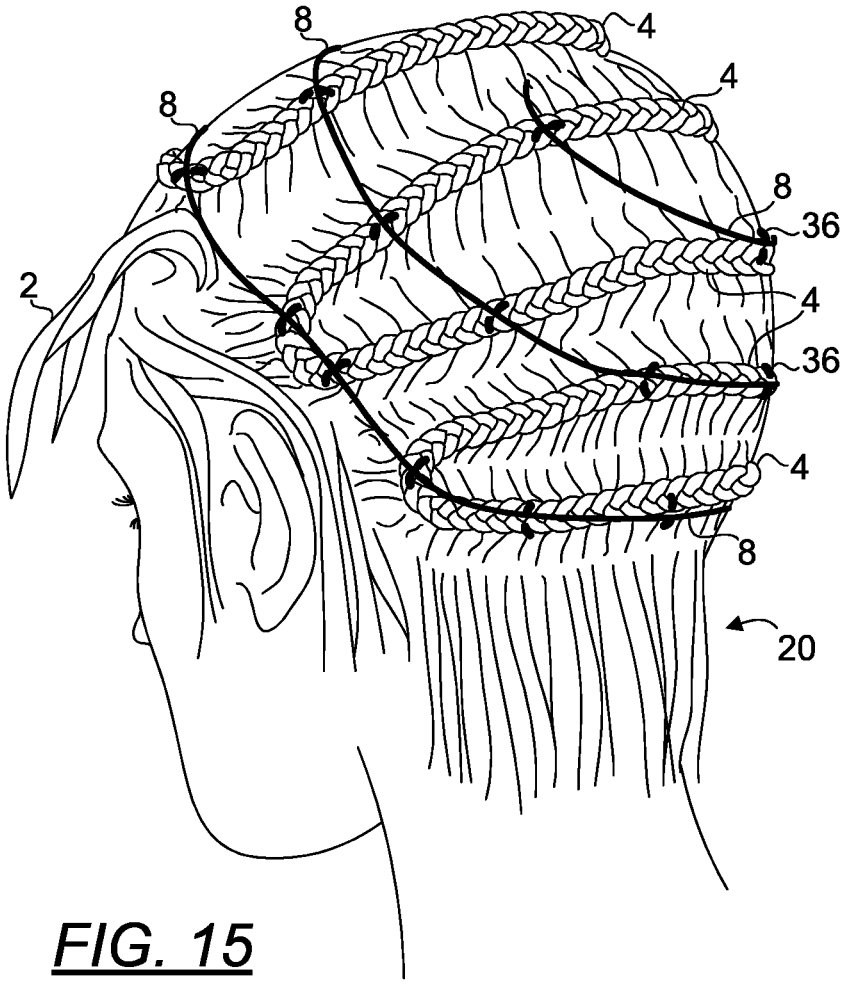
FIG. 15 is a rear perspective view of a wearer depicting the positioning of a continuous holder having been secured to braids in a spiral format.

For cases where unnatural or fake look is a concern, the holder may alternatively be secured in a format depicted in FIG. 15. FIG. 15 depicts an alternate configuration of the present hair extension holder where a long continuous holder is used. For clarity, the figure depicts only a simplified holder (in thick black line) that is wound in a spiral format following the natural curvature starting from the nape and terminating at the top of the head. Such a holder is designed to receive multiple narrow pieces of hair extensions or a single piece of wide hair extension.

Figure 16:
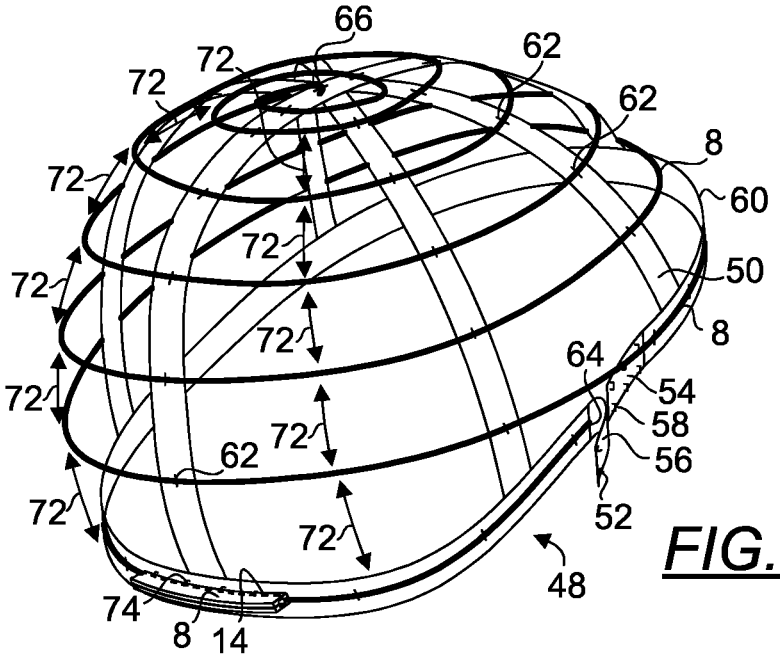
FIG. 16 is a rear perspective view of an assembled holder depicting a continuous holder being assembled in an arrangement ready to be affixed onto a wearer's head.

FIG. 16 is a rear perspective view of an assembled holder depicting a continuous holder 8 being assembled in an assembly 48 ready to be affixed onto a wearer's head. Only a small portion of the holder 8 is shown. Other portions of the holder 8 is represented again with a thick black line. The holder is configured to be wound into a coil in a spiral format ranging from an outside periphery end 64 to a central end 66. The coil forms a plurality of loops, each spaced at a perpendicular distance 72 from an adjacent loop. The outer adjustment band 60 is essentially a cut band configured in a circular fashion, sized substantially to fit a wearer's head and connected by an adjuster which allows adjustability of the perimeter traced by the cut band. In order to allow adjustability, an adjuster is provided. In one embodiment, the adjuster is a male and female adjustment straps 52, 54 pair where one of several rows of hooks 56 that are disposed on the male adjustment strap 52 is configured to be engaged with one of several rows of eyelets 58 disposed on the female adjustment strap 54. The male adjustment strap 52 is shown in a peeled back condition to more clearly reveal the female adjustment strap 54. It shall be apparent that a hook and loop combination may also be used. The male and female adjustment straps 52, 54 are preferably fabricated from an elastic material. Starting from the outside periphery end 64, the holder 8 is affixed to the outer surface of the outer adjustment band 60 to form a bottom loop, substantially encircling and being attached to the outer adjustment band 60 with thread 74. Upon diverging from the bottom loop, the holder 8 traces a second loop spaced at a perpendicular distance 72 from the bottom loop. This pattern continues with a third loop spaced at another perpendicular distance 72 from the second loop.

In order to ensure consistent spacing (i.e., along the length of each loop) between the loops to ensure optimal appearance of the hair extension, a plurality of connecting straps 50 is connected to each loop. Each connecting strap 50 includes two longitudinal ends where one of which is connected to a longitudinal end of all other connecting straps 50 at and to the central end 66. The second longitudinal end of each connecting strap 50 is connected to a portion of the outer adjustment band 60. Each loop is secured by means of securing thread 62 through the plurality of apertures 14 to the connecting straps 50 such that each loop is maintained at a substantially consistent perpendicular distance 72 from an adjacent loop.

Figure 17:
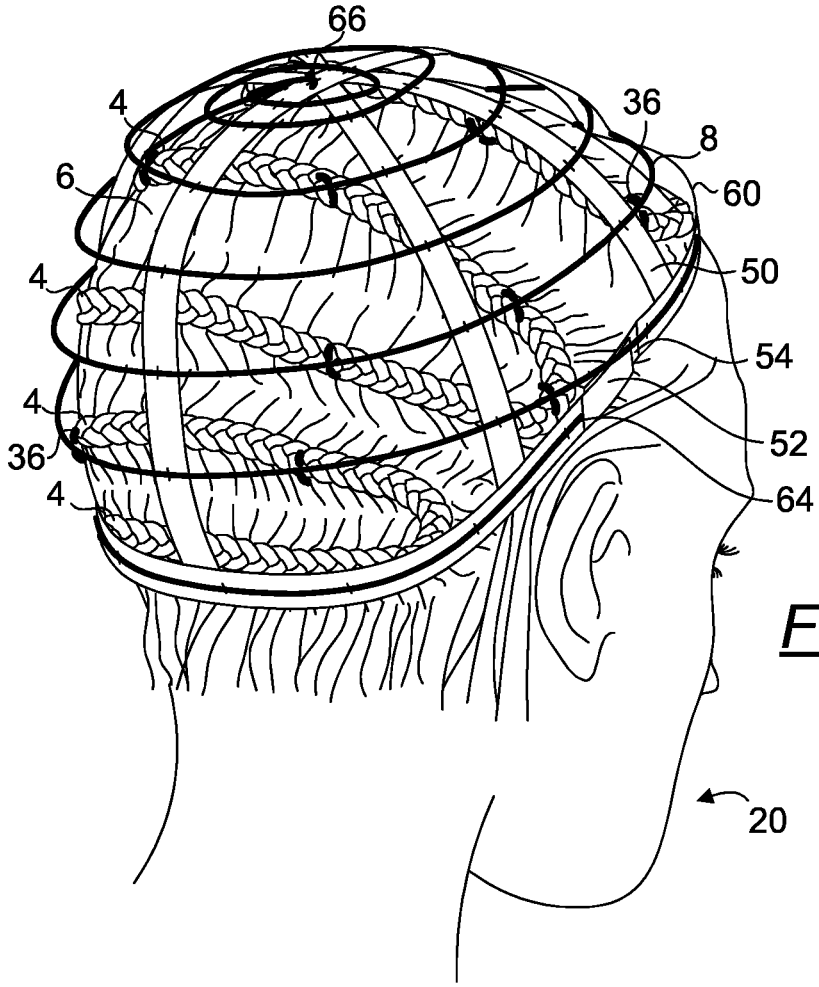
FIG. 17 is a rear perspective view of a wearer, depicting the positioning of a holder assembly having been secured to braids.

FIG. 17 is a rear perspective view of a wearer, depicting the positioning of a holder assembly 48 having been secured to braids. The holder assembly 48 has been properly disposed on a wearer's head such that it encompasses approximately the area of scalp 6 where natural hair growth occurs. The assembly 48 is then threadably attached to the braided hair 4 via the apertures 14 at appropriate locations. By providing the holder 8 in an assembly format, ready to be deployed, the hairdresser responsible for attaching the holder 8 to a wearer's head is relieved from the chore of arranging the holder 8 in manner to suitably cover the scalp area. However, by using the assembly, the opportunity for accidentally exposing an artificial device underneath the cover of hair extensions increases. The Applicant discovered that by either threadably attaching the holders 8 to the braided hair directly or to the outer adjustment band 60, the holder 8 tends to rest in a configuration with its opening pointing downwardly due to the weight of the installed hair extensions, thereby creating a natural look and concealing the holder assembly. Each connecting strap 50 and the outer adjustment band 60 may be fabricated from a fabric, a thin plastic or rubber which enables the assembly to be collapsed for storage or transportation. While fabricated from a fabric, the connecting straps 50 and the outer adjustment band 60 may be configured in a color similar to the color of one's scalp or hair color. In another embodiment, these parts are fabricated from a thin plastic or rubber such that they are sufficiently flexible as to conform to the shape and size of the wearer's scalp. While fabricated from a thin plastic or rubber, these parts may also be made of a transparent material with a dull surface so as to reduce light reflection and therefore be more discreet as they are accidentally or temporarily revealed. It shall also be noted in FIG. 17 that the male adjustment strap 52 is engaged with the female adjustment strap 54 to form a snug fit of the assembly 48 over the scalp of the wearer 20. The adjuster is preferably disposed on a side (or near a temple) of the wearer's head instead of the nape or top of the head. As the adjuster is accessible to the wearer in this position, any necessary adjustment can be made by the wearer herself without a hairdresser's help.

Figure 18:
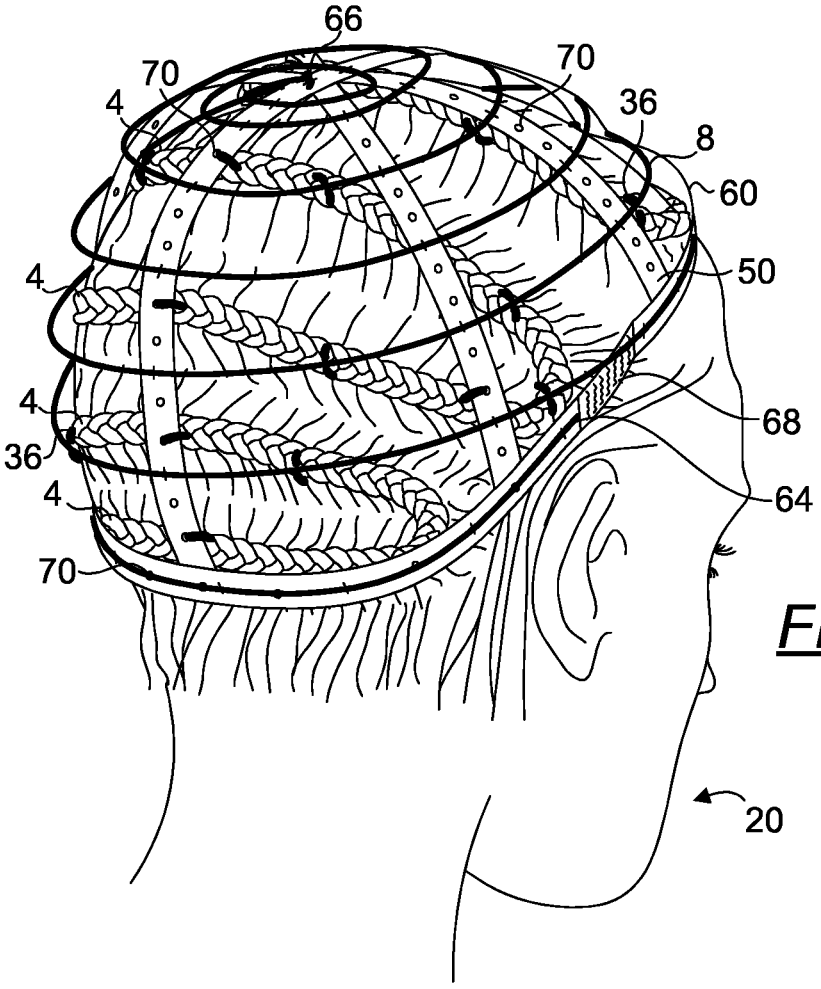
FIG. 18 is a rear perspective view of a wearer, depicting the positioning of a holder assembly having been secured to braids and the use of elastic band to allow adjustment of the outer adjustment band and apertures disposed on connecting straps and outer adjustment band to allow threadable attachment of the same to the braided hair.

FIG. 18 is a rear perspective view of a wearer depicting the positioning of a holder assembly having been secured to braids and the use of an elastic band 68 to allow adjustment of the outer adjustment band 60 and apertures 70 disposed on connecting straps 50 and outer adjustment band 60 to allow threadable attachment of the same to the braided hair 4. The apertures 70 provide an increased number of attachment points on the assembly such that an increased number of attachments of the assembly to the wearer's braided hair 4 or more suitable attachments of the assembly to the braided hair 4 can be made.

Figure 19:
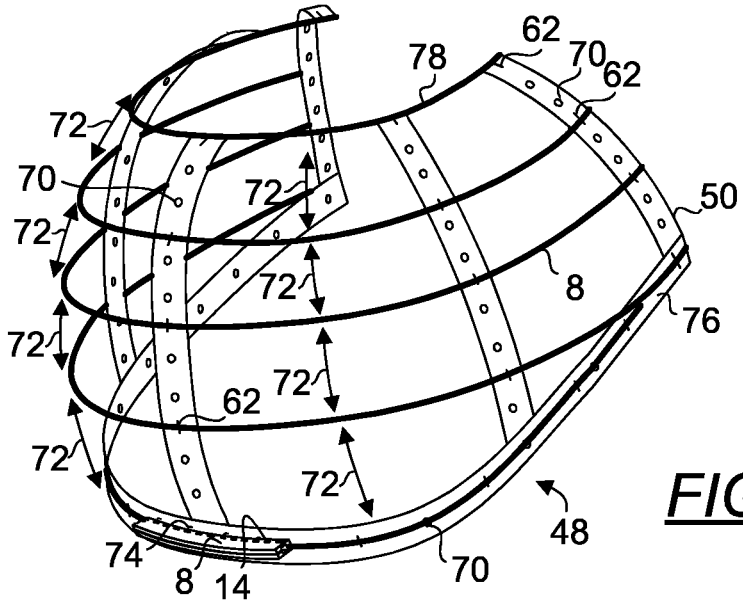
FIG. 19 is a rear perspective view of an alternative embodiment of a holder assembly, depicting a plurality of holders being assembled in an arrangement ready to be affixed onto a wearer's head.

FIG. 19 is a rear perspective view of an alternative embodiment of a holder assembly, depicting a plurality of holders being assembled in an arrangement ready to be affixed onto a wearer's head. This embodiment is similar to those disclosed in FIGS. 16-18 with the exception that the space delineated by the holder coil 8 is not closed, thereby enabling a wearer the freedom to blend her natural hair, especially hair portions just above the forehead and on top of her head, to the hair extensions installed with this holder assembly. It shall be noted that the space outlined by the top loop 78 is also open to enable the wearer's hair to protrude her unwoven natural hair portions through this space to blend in with hair extensions installed on the holders 8. Similar to the embodiments of FIGS. 16-18, the holder assembly of FIG. 19 is capable of retaining its structure and shape, making it convenient to be disposed on and affixed to a wearer's natural woven hair. A non-closed curved outer band 76 having a forward facing opening is disposed on the bottom fringe of the assembly. A plurality of appropriately sized non-closed hair extension holders 8, each having a forward facing opening, is also provided. One of the plurality of holders 8 is disposed around the outer band 76 with the opening of the holder aligned with the opening of the outer band 76. The rest of the plurality of holders 8 is disposed in a stacked configuration with their openings aligned with the opening of the outer band 76 to form a plurality of non-closed stacked loops terminating at a top loop 78. Each loop is preferably spaced at a consistent perpendicular distance from an adjacent loop. One longitudinal end of each connecting strap 50 is connected to a portion of the top loop 78 and the other longitudinal end of each connecting strap 50 is connected to a portion of the outer band 76. Each loop is attached to a portion of each connecting strap 50 such that each of the plurality of loops is disposed at a perpendicular distance substantially consistent from an adjacent loop.

I claim:

1. A hair extension holder for securing a hair extension having a weft and a hair piece extending from said weft, to a wearer's natural hair, said hair extension holder includes a length, a transverse profile having a hair extension edge and a securing edge opposingly disposed from said hair extension edge, said hair extension holder comprises:

(a) an elongated channel disposed substantially longitudinally along the entire length of said hair extension holder, said channel includes a neck and an interior cavity connected to said neck, wherein said neck defines an opening along the length of said elongated channel at said hair extension edge; and (b) a plurality of apertures disposed substantially along said securing edge, wherein said plurality of apertures is configured to receive a plurality of threads for securing said hair extension holder to the wearer's natural hair, said interior cavity is configured to receive the weft in its entirety and said neck is configured to enable penetration of said hair piece through said opening and said hair extension holder is further configured for use with a sub-assembly comprising:

(i) an outer adjustment band having a perimeter length, said outer adjustment band is configured substantially in a circular fashion; and (ii) a plurality of connecting straps, each having two longitudinal ends, wherein said hair extension holder is configured to be wound into a coil ranging from an outside periphery end to a central end and having a plurality of loops, each spaced at a perpendicular distance from an adjacent loop, said outside periphery end is affixed to a portion of said outer adjustment band, one longitudinal end of each said connecting strap is connected to one longitudinal end of all other connecting straps and to said central end and the other longitudinal end of each said connecting strap is connected to a portion of said outer adjustment band such that said coil is configured to retain each of said plurality of loops in a substantially consistent perpendicular distance from an adjacent loop and said plurality of apertures is further configured to receive a plurality of threads for securing said elongated channel to said plurality of connecting straps.

2. The hair extension holder of claim 1, wherein the perimeter length of said outer adjustment band is configured to be adjustably effected with an adjuster selected from the group consisting of a hook-eyelet pair, a hook and loop pair and an elastic band.

3. The hair extension holder of claim 1, wherein at least one of said plurality of connecting straps and said outer adjustment band comprises at least one aperture configured to receive at least one thread for securing said assembly to the wearer's natural hair.

4. The hair extension holder of claim 1 is constructed from a material selected from the group consisting of plastic and rubber.

5. The hair extension holder of claim 4, wherein said material is transparent.

6. The hair extension holder of claim 1, further comprising a plurality of notches spaced apart along said length of said hair extension holder, wherein said plurality of notches are configured to facilitate bending of said hair extension holder.

* * * * *